United States Patent [19]

Chalifour et al.

[11] 4,127,830

[45] Nov. 28, 1978

[54] MICROSTRIP SWITCH WHEREIN DIODES ARE FORMED IN SINGLE SEMICONDUCTOR BODY

[75] Inventors: Henri R. Chalifour, Methuen, Mass.; Thomas A. Rose, Nashua, N.H.; Mark B. Goldman, Sudbury, Mass.

[73] Assignee: Raytheon Company, Lexington, Mass.

[21] Appl. No.: 800,992

[22] Filed: May 26, 1977

[51] Int. Cl.[2] ..... H01P 1/15

[52] U.S. Cl. ..... 333/7 D; 357/56

[58] Field of Search ..... 333/7 D, 84 M; 357/56

[56] References Cited

U.S. PATENT DOCUMENTS

| | | | |
|---|---|---|---|
| 3,223,947 | 12/1965 | Clar | 333/7 D |
| 3,597,706 | 8/1971 | Kibler | 333/7 D |
| 3,746,587 | 7/1973 | Rosvold | 357/56 X |

*Primary Examiner*—Paul L. Gensler

*Attorney, Agent, or Firm*—Richard M. Sharkansky; Joseph D. Pannone

[57] ABSTRACT

A microwave switch including a microstrip circuit having a plurality of strip conductors disposed on a planar surface of a dielectric substrate, a plurality of diodes having first electrodes connected to corresponding ones of the strip conductors, and a feed line disposed in a plane different from the planar surface of the substrate and connected to a second electrode of the diodes.

5 Claims, 11 Drawing Figures

MICROSTRIP SWITCH WHEREIN DIODES ARE FORMED IN SINGLE SEMICONDUCTOR BODY

BACKGROUND OF THE INVENTION

This invention relates generally to microwave switches and, more particularly, to microwave switches which use switching diodes.

As is known in the art, microwave switches generally include a microstrip circuit having an input or feed line and a plurality of output lines all lying in a single plane, such input line being coupled to the output line through discrete switching diodes connected between the input line and corresponding ones of the output lines. The switching diodes are generally two-junction semiconductor devices, sometimes referred to as P I N diodes. In order to obtain proper impedance matching between the input line and each of the output lines, it is necessary that the output lines be sufficiently separated from each other to prevent significant stray coupling or fringing effects. Further, to obtain the proper matching, it is necessary that the diodes have one electrode connected at substantially coincident points on the input line.

Because of the co-planar arrangement described above in many applications, as for example when greater than, say nine, output lines are required, the requisite separation and bonding criteria is impractical to achieve. Also, with such co-planar arrangement, because the input line is not symmetrically positioned with respect to the output lines, different ones of the output lines will have different degrees of stray coupling or fringing to the input line, and, hence, the impedance matching between the input line and each of the output lines will be correspondingly different. Further, the switching diodes are generally capable of handling only relatively low levels of power because, in the co-planar arrangement described above, a significant portion of the heat generated in the switching diodes passes through substantially the entire diode to the ground plane of the microstrip circuit. Still further, in such arrangement, because each of the switching diodes is a discrete device, the electrical characteristics may be different one from the other, thereby affecting the electrical switching characteristics of the input line to each of the output lines.

SUMMARY OF THE INVENTION

With this background of the invention in mind, it is therefore an object of this invention to provide an improved microwave switch.

This and other objects of the invention are attained generally by providing a microwave switch having: a microstrip circuit including a plurality of strip conductors disposed on a planar surface of a dielectric substrate; a plurality of diodes having first electrodes connected to corresponding ones of the strip conductors; and a feed line disposed in a plane different from the planar surface of the substrate and connected to a second electrode of the diodes.

In a preferred embodiment of the invention, the plurality of diodes are formed in a single semiconductor body, and, hence, have substantially the same electrical characteristics. The strip conductors extend radially from an axis perpendicular to the plane of the dielectric substrate. The dielectric substrate and the semiconductor body are toroidal shaped, the feed line passing through the center region of such substrate and body, coaxial with the perpendicular axis and being connected to the second electrode of the diodes. A coaxial feed-through provides an outer conductor for the feed line and such outer conductor is connected to the ground plane of the microstrip circuit.

With such arrangement, the feed line is symmetrically disposed with respect to each of the output microstrip transmission lines, providing matched impedances between the feed line and each of the output lines. Further, a significant portion of heat produced in the diodes flows through the first electrodes to the strip conductors and dielectric substrate, rather than through substantially the entire diode, thereby increasing the power handling capability of the microwave switch by reducing the thermal impedance of the diode junctions.

BRIEF DESCRIPTION OF THE DRAWINGS

The foregoing features of this invention, as well as the invention itself, may be more fully understood from the following detailed description read together with the accompanying drawings, in which.

DESCRIPTION OF THE PREFERRED EMBODIMENT

Figure 1:
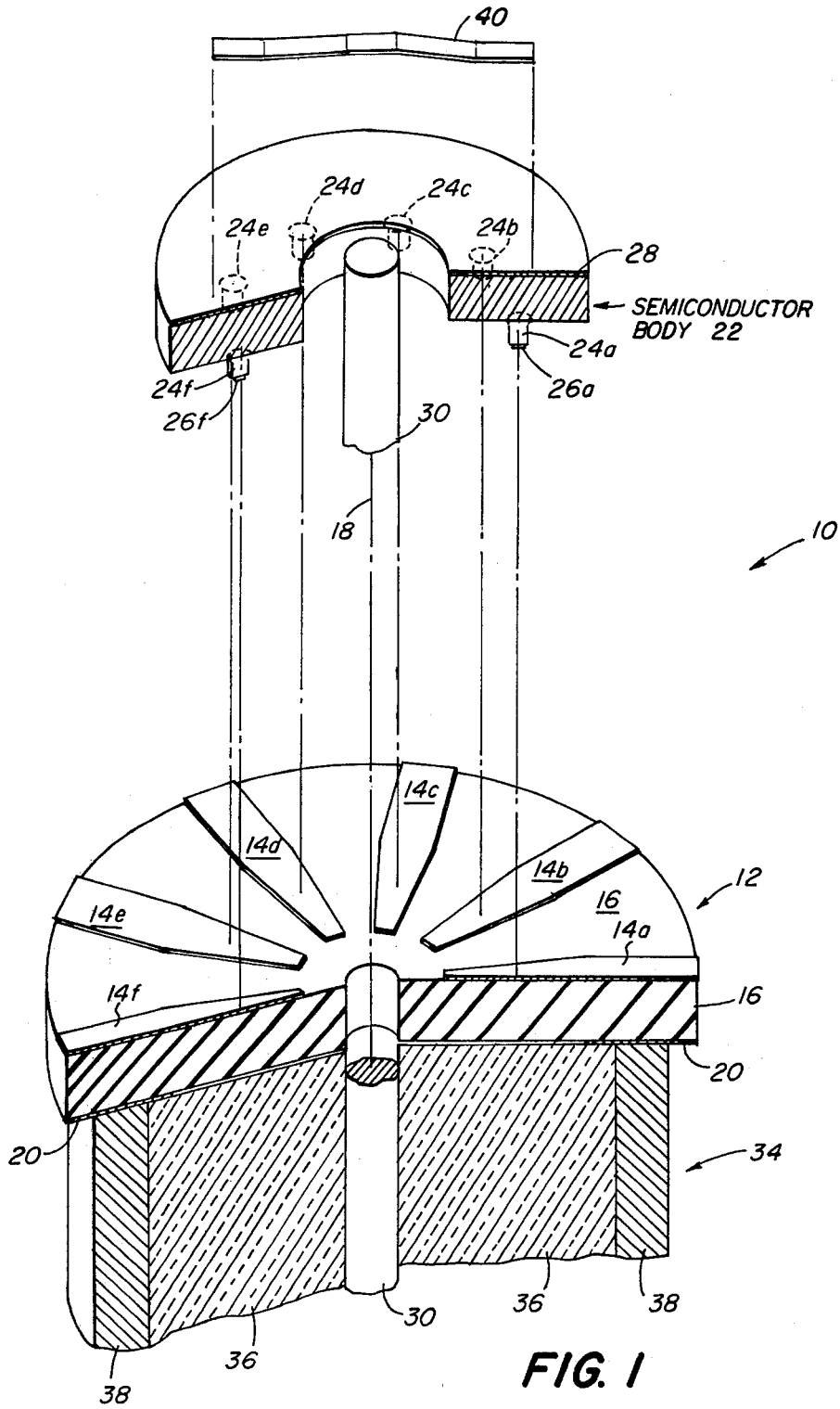
FIG. 1 is a simplified and somewhat distorted isometric drawing, exploded and partially cut away, of a microwave switch according to the invention.
Figure 3A:
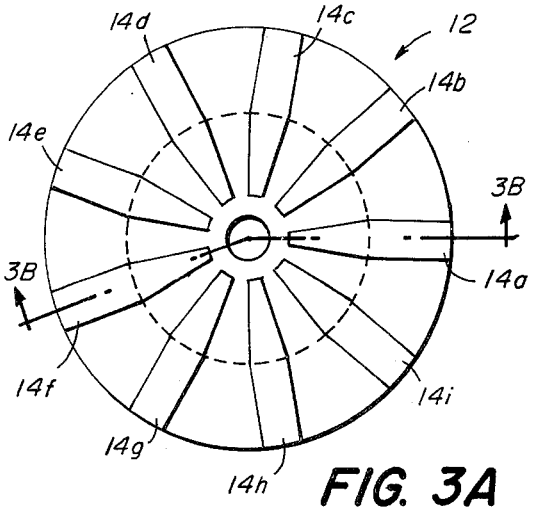
FIG. 3A is a plan view of a microstrip circuit used in the microwave switch shown in FIGS. 1 and 2.
Figure 3B:
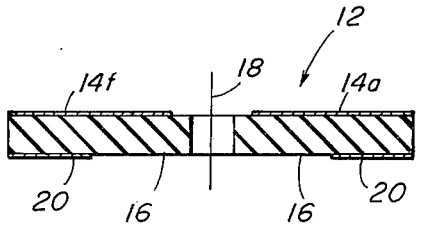
FIG. 3B is a cross-sectional view of the microstrip circuit taken along line 3B — 3B of FIG. 3A.
Figure 2:
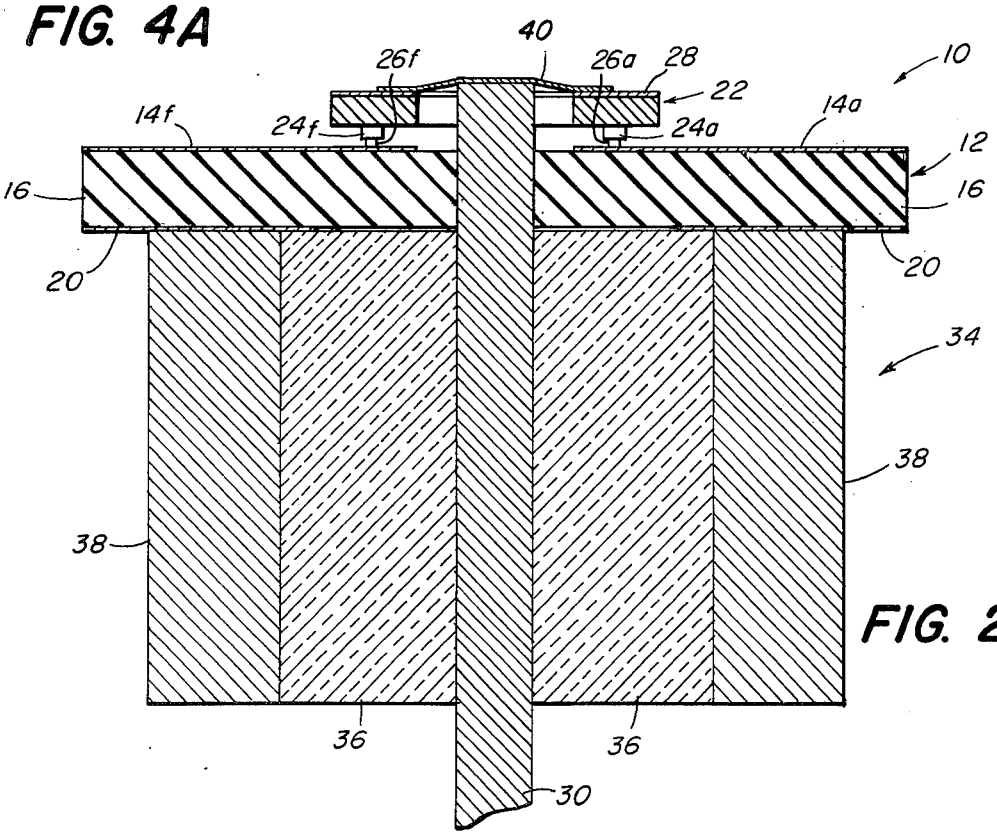
FIG. 2 is an elevation view, somewhat simplified, of the microwave switch shown in FIG. 1.

Referring now to FIGS. 1 and 2, a microwave switch 10 is shown to include a microstrip circuit 12 having a plurality of, here nine, strip transmission lines. In particular, such microstrip circuit 12, shown in detail in FIGS. 3A and 3B, includes nine strip conductors **14*a*–14*i* disposed on a planar surface of a toroidal shaped dielectric substrate 16, and a ground plane 20 formed on the opposite planar surface of such substrate 16 as shown. Such microstrip circuit 12 is formed using an alumina substrate having a gold layer evaporated on the substrate and removing unwanted regions of such gold by conventional photolithography and etching processes. The strip conductors 14*a*–14*i* extend radially from an axis 18, such axis 18 passing through the center of the dielectric substrate 16 and being disposed perpendicular to the planar surfaces of such substrate 16. The strip conductors 14*a*–14*i* are regularly spaced about the surface of the dielectric substrate 16**, i.e., here every 40° as indicated in FIG. 3A.

Here the microwave switch 10 is adapted to operate over the frequency band 2 to 8 GHz, and the strip conductors **14*a*–14*i*, dielectric substrate 16 and ground plane 20 form nine microstrip transmission lines each having an impedance of 50 ohms. The outer diameter of the dielectric substrate 16 is here 0.1 inches, the inner diameter thereof is here 0.013 inches, and the thickness is here 0.01 inches. The strip conductors 14*a*–14*i* have a width, at the outer periphery, of here 0.01 inches which extends a length 0.02 inches and then tapers down to a width of 0.004 inches over a length of 0.02 inches. The inner diameter of the ground plane 20 is here 0.06 inches and hence is disposed underneath the wider portions of the strip conductors 14a–14i**, as indicated by the dotted line in FIG. 3A.

Figure 4A:
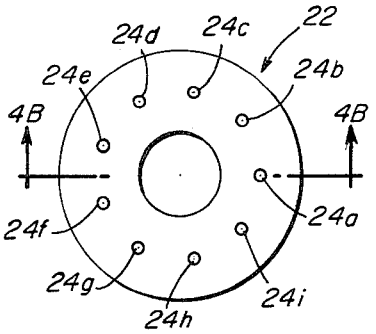
FIG. 4A is a plan view of a semiconductor body having a plurality of microwave switching diodes used in the microwave switch shown in FIGS. 1 and 2.
Figure 4B:
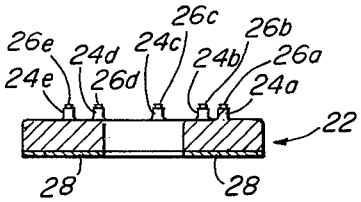
FIG. 4B is a cross-sectional view of the semiconductor body taken along line 4B — 4B of FIG. 4A.

Referring again to FIGS. 1 and 2, the microwave switch 10 includes a single semiconductor body 22 having a plurality of, here nine, microwave switching diodes 24a–24i, as shown also in FIGS. 4A and 4B, formed in a manner to be described in detail in connection with FIGS. 5A–5E. Suffice it to say here that such semiconductor body 22 is toroidal shaped, here having an outer diameter of 0.05 inches and an inner diameter of 0.020 inches. The switching diodes 24a–24i are disposed along a circle, here having a diameter of 0.035 inches. When assembled, the center of the semiconductor body 22 is disposed along the axis 18 and the goldplated electrodes 26a–26i of the microwave switching diodes 24a–24i, respectively, are in electrical contact with the strip conductors 14a–14i, respectively, as indicated in FIGS. 1 and 2. Such connection is here made by applying heat, pressure and mechanical agitation to the semiconductor body 22 and microstrip circuit 12 to thermocompression bond the goldplated electrodes 26a–26i to corresponding ones of the gold strip conductors 24a–24i. Disposed on one side of the semiconductor body 22 is a conductor 28, here gold, which provides a second electrode for all of the nine diodes 24a–24i.

An input or feed line 30, here an electrical conductor having a diameter of 0.012 inches and made of Kovar material, is provided as shown in FIGS. 1 and 2. The input line 30 passes coaxially with axis 18 through a 50 ohm feed-through 34 and the center regions of microstrip circuits 12 and semiconductor body 22, to a conductive ribbon 40 as indicated. The feed-through 34 has an outer conductor 38, here, a gold-plated Kovar material, a dielectric separator 36, here glass, and has a length of 0.06 inches. The conductive ribbon 40 is gold, and such ribbon is thermocompression bonded to the end of the input line 30 and to the electrode 28 to provide an electrical connection between such electrode 28 and the input line 30. The outer conductor 38 of the feed-through 34 is electrically connected to the ground plane 20 of the microstrip circuit 12, here by soldering a suitable gold-tin alloy in a suitable hydrogen atmosphere in any well-known manner. When assembled input line 30 and feed-through 34 provide a coaxial transmission line, here having a 50 ohm impedance, for coupling energy between coaxial transmission line and a selected one or ones of the microstrip transmission lines via corresponding selected one or ones of the switching diodes 24a–24i and the one or ones of strip conductors 14a–14i correspondingly connected thereto.

Figure 5A:
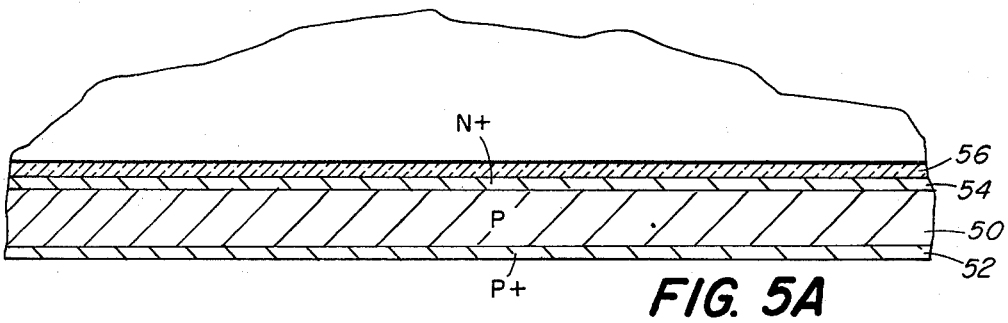
FIGS. 5A-5E are drawings, greatly simplified and somewhat distorted, useful in understanding the process of making the semiconductor body shown in FIGS. 4A and 4B.

Referring now to FIGS. 5A–5E, a method for forming the plurality of switching diodes 24a–24i will now be discussed. As shown in FIG. 5A, a semiconductor substrate 50, here a 1½ inch diameter wafer, of P type conductive silicon having planar surfaces disposed in the <111> crystallographic plane of such silicon wafer and a thickness of here 0.01 inches is provided. A P+ type conductivity layer 52 is epitaxially formed over one surface of the semiconductor substrate 50 to a thickness of here 0.004 inches using any conventional process, here using a boron dopant, the epitaxial layer 52 having a resistivity of here 0.001 ohm/cm. The opposite surface of the semiconductor substrate 50 is then back polished, lapped and etched, using conventional processes to reduce the thickness of the semiconductor substrate 50 to a thickness here of 25 microns. An N+ type dopant, here phosphorus having $10^{20}$–$10^{21}$ atoms per $cm^3$, is diffused into such opposite surface of the semiconductor substrate 50 using any conventional diffusion process to form an N+ type conductivity layer 54, here 3 microns thick, in such semiconductor substrate 50, as indicated. A layer 56 of silicon dioxide is then deposited over the N+ type conductivity layer 54, here using any conventional chemical vapor depositon process.

Figure 5B:
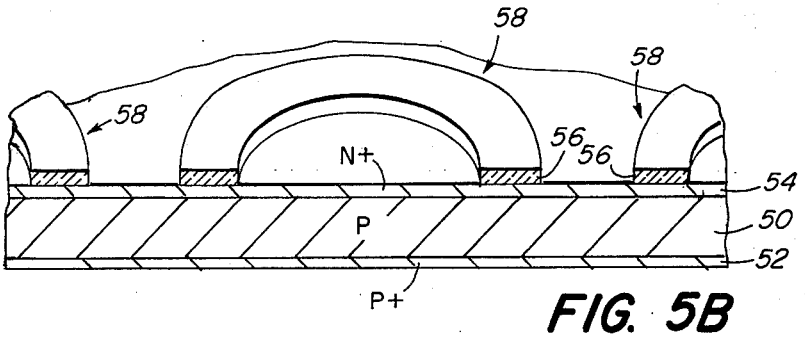
Figure 5C:
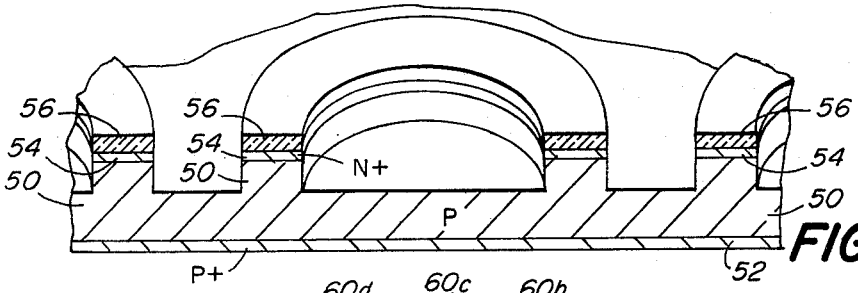

Referring now to FIG. 5B, the silicon dioxide layer 56 is shown after selected regions thereof have been etched away using any conventional photolithographic process to form toroidal shaped silicon dioxide masks 58, as indicated. The masked surface is exposed to a suitable solution of $HF$-$HNO_3$-$H_2O$ to chemically etch exposed portions of the silicon in a conventional manner, such etching process removing such portions of the silicon, here to a depth of 0.001 inches. The resulting structure is shown in FIG. 5C. As indicated in FIG. 5C, toroidal shaped P and N+ regions (i.e., layers 50, 54) are formed by the mask 58 and the etching process described.

Figure 5D:
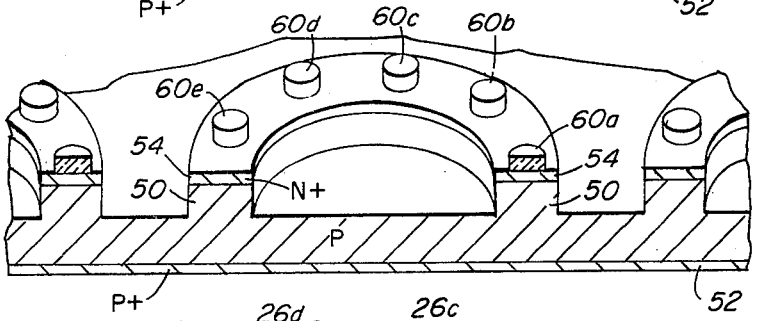
Figure 5E:
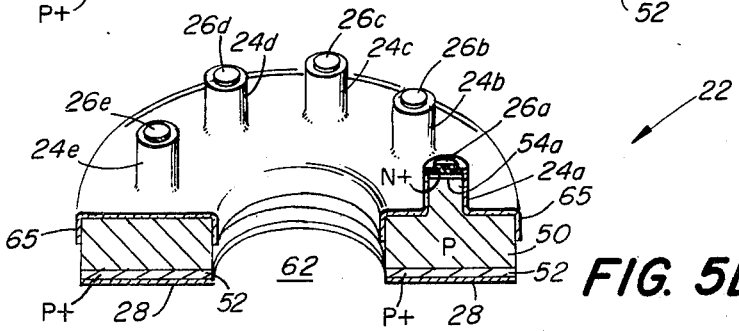

In order to form the plurality of individual diodes 26a–26i (FIG. 1) in each of the toroidal shaped P and N+ regions (i.e., layers 50, 54), the silicon dioxide layer 56 (FIG. 1) is removed using any conventional process and a new layer of silicon dioxide is deposited over the upper surface of the silicon using any conventional chemical vapor deposition process to, inter alia, passivate the surface of the silicon. The silicon dioxide layer is then masked and etched using any conventional photolithographic process to form nine circular chimney-shaped regions 60a–60i (only 60a–60e being shown in FIG. 5D) of silicon dioxide over each one of the toroidal shaped layers 50, 54, as shown in FIG. 5D. A suitable hydrofluoric acid solution is used to etch away portions of the layers 50, 54, which are not masked by the nine chimney-shaped regions separating each N+ layer 54 (60a–60i), thereby forming nine individual N+ regions 54a–54i (only 54a being shown in FIG. 5E). The boundaries between the N+ regions (54a–54i) and the substrate 50 form nine individual semiconductor p-n junctions. To improve the reliability of the semiconductor devices a silicon dioxide layer 65 is here deposited over the p-n junction regions to isolate the p-n junctions from the surrounding ambient. The silicon dioxide layer 65 is deposited over the entire wafer using any conventional chemical vapor deposition process then treated to densify and dry the oxide in accordance with well-known procedures. The silicon dioxide layer 65 is then masked and etched, using any conventional process, to form nine circular holes in the silicon dioxide layer 65, one over each of the nine N+ regions (54a–54i), as shown in FIG. 5E. Completing the process, chrome and then gold are evaporated over the entire upper surface and then are selectively removed, except from the N+ regions 54a–54i which are exposed by the holes in the silicon dioxide layer 65 to provide ohmic contacts to such exposed N+ regions 54a–54i using any conventional metalization-masking/etching process. The evaporated gold layers are then plated with additional gold to increase the thickness of the gold, here 1 to 2 mils, thereby to provide the electrodes 26a–26i (FIGS. 1, 2, 4A, 4B).

The lower surface of the semiconductor body 22 is next processed by evaporating chrome and gold over such surface to form the second electrode 28, as indicated in FIG. 5E, such second electrode 28 being thereby formed in ohmic contact with the P+ type conductivity layer 52. The evaporated gold and chrome are then masked and etched using conventional photolithographic techniques to form a toroidal metalized pattern of the same approximate dimensions and in alignment with the etched region formed by mask 58 (FIG. 5B). The P+ region 52 and central region 62 of the substrate 50 are then etched in a suitable $HF-HNO_3-H_2O$ solution using the toroidal metalized pattern as a mask to form the toroidal shaped semiconductor body shown in FIG. 5E. During this process the entire wafer is mounted with its upper surface buried in a suitable etch-resistant wax, such as on a wax coated glass slide, to prevent etching of the nine diodes previously formed. It is first noted that, while each one of the switching diodes has a separate N+ type region **54*a*–54*i*, they have a P type region 50 and a P+ type layer 52 which is common to all diodes 24*a*–24*i*. Further, the second electrode 28 is common to all diodes 24*a*–24*i*. Still further, all diodes 24*a*–24*i* are formed from the same silicon wafer and are formed in essentially a common region of such wafer, thereby insuring that each of the diodes used in the microwave switch will have substantially identical electrical characteristics, and hence, substantially identical switching characteristics. Still further, each of the switching diodes 24*a*–24*i* are two-junction devices and, hence, provide relatively low impedance to microwave energy while being able to be switched between a conducting state and a non-conducting state in response to d.c. biasing control signals fed to the diodes 24*a*–24*i* through corresponding ones of the individual strip conductors 14*a*–14*i* and the input line 30. While such junctions are made up of N+ P P+ regions (often referred to as N I P diodes or N $\pi$ P diodes), the diodes 24*a*–24*i*** may be considered part of a general class of P I N diodes. In particular, in an alternative embodiment of the invention, the semiconductor body may be made up of an N-type intrinsic silicon wafer having an epitaxial layer of N+ type conductivity material formed on one surface of such wafer and P+ type conductivity layer formed on the other surface of such wafer forming nine P I N diodes. Further, conventional N on N+ or P on P+ epitaxial wafers may be used as a starting point in place of the so-called inverse epitaxial process described here, this alternative producing P+ N N+ or N+ P P+ devices for similar application but having somewhat different electrical characteristics.

Having described a preferred embodiment of the invention, it is evident that other embodiments incorporating these concepts may be used. For example, other than nine strip transmission lines may be used, and the operating frequencies and, hence, dimensions may be other than those specified. Still further, while the feed line 30 has been sometimes referred to as an "input line", as where microwave signals fed thereto are coupled to selected ones of the strip transmission lines in response to forward biasing control signals supplied to selected ones of the diodes via the strip conductors and line 30, it should be noted that principles of reciprocity apply and hence, such line 30 may serve as an output line as where microwave signals fed to each of the strip conductors may be selectively coupled to the line 30 in response to biasing control signals supplied to selected ones of the diodes. It is felt, therefore, that this invention should not be restricted to the disclosed embodiment, but rather should be limited only by the spirit and scope of the appended claims.

What is claimed is:

1. A microwave device, comprising:

a. a microstrip circuit including a plurality of strip conductors disposed on a planar surface of a dielectric substrate, such strip conductors extending radially from an axis perpendicular to the plane of the substrate, such circuit being toroidal and symmetrically disposed about such axis;

b. a toroidal semiconductor body having a plurality of mesa shaped diodes and first electrodes formed on top regions of corresponding ones of the diodes, such semiconductor body being disposed symmetrically about the axis, each one of the first electrodes being directly bonded to a corresponding one of the strip conductors; and c. a feed line disposed coaxially with the axis and passing through center regions of the microstrip circuit and the semiconductor body, such feed line being electrically connected to a second electrode of the diodes.

2. The microwave device recited in claim 1 including a feedthrough having an outer conductor connected to a ground plane of the microstrip circuit and wherein the feed line passes through the feedthrough.

3. The microwave device recited in claim 1 wherein the microstrip circuit includes an alumina substrate.

4. The microstrip device recited in claim 1 wherein the mesa shaped diodes are formed on one surface of the semiconductor body and the second electrode is formed as a common electrode of an opposite surface of such semiconductor body.

5. The microstrip device recited in claim 1 wherein p-i-n regions are formed in each one of the mesa shaped diodes.

* * * * *